United States Patent [19]

Carbonnel

[11] 4,030,538

[45] June 21, 1977

[54] DEVICE FOR ADJUSTING THE QUANTITY OF MOLTEN METAL USED IN PRESSURE CASTING

[75] Inventor: Henri Carbonnel, Antony, France

[73] Assignee: Groupement pour les Activities Atomiques et Advancees "GAAA" S.A., Le Plessis Robinson, France

[22] Filed: June 30, 1976

[21] Appl. No.: 701,277

[30] Foreign Application Priority Data

July 7, 1975 France ..... 75.21254

[52] U.S. Cl. ..... 164/312; 137/577; 164/133; 164/155; 164/250

[51] Int. Cl.[2] ..... B22D 17/30

[58] Field of Search ..... 164/133, 134, 49, 147, 164/250, 312, 306, 119, 155, 316, 317, 318, 307, 308, 309, 310, 193; 222/252, 255; 425/147; 137/563, 577, 593

[56] References Cited

UNITED STATES PATENTS

| | | | |
|---|---|---|---|
| 1,625,592 | 4/1927 | Conant et al. | 137/563 |
| 2,224,982 | 12/1940 | Morin | 164/49 |
| 3,274,985 | 9/1966 | Traver et al. | 137/577 |
| 3,385,473 | 5/1968 | Forcesi | 164/155 X |
| 3,884,291 | 5/1975 | Balevski et al. | 164/312 |

*Primary Examiner*—Ronald J. Shore
*Assistant Examiner*—Gus T. Hampilos
*Attorney, Agent, or Firm*—Sughrue, Rothwell, Mion, Zinn & Macpeak

[57] ABSTRACT

A device for adjusting the quantity of molten metal used in pressure casting has a pump pumping molten metal up from a supply container to a pressure chamber and to a level-determining tank having an adjustable overflow. Hydrostatic pressure balances the levels in the level-determining tank and the pressure chamber so that adjusting the overflow also adjusts the level of metal in the pressure chamber.

4 Claims, 4 Drawing Figures

DEVICE FOR ADJUSTING THE QUANTITY OF MOLTEN METAL USED IN PRESSURE CASTING

BACKGROUND OF THE INVENTION FIELD OF THE INVENTION

The present invention relates to a device for adjusting the quantity of molten metal used in pressure die casting.

DESCRIPTION OF THE PRIOR ART

Known industrial pressure casting installations comprise a holding furnace or a crucible containing molten metal for casting and a pressure chamber which usually consists of a piston and cylinder. For pressure casting, supply means for the pressure chamber are arranged to load the same quantity of molten metal into the cylinder repeatedly.

One of the more difficult problems in casting is the provision of the desired quantity of molten metal with as great an accuracy as possible while at the same time arranging for the applied pressure to be as exact as desired.

In known devices the quantity of molten metal provided is generally defined mechanically, for example by positioning of the piston which is also used to apply the pressure.

It is apparent that it would be advantageous to have some device for fine adjustment of the level of molten metal in the pressure chamber enabling the quantity of metal used to be accurately standardised.

One idea for providing fine adjustment is to have a balancing tank connected to the pump circuit. The level in the balancing tank is precisely adjustable and the quantity of metal used can be adjusted to better than one gramme in several kilogrammes. Such accuracy is desirable for laboratory work and most adequate for industrial work.

SUMMARY OF THE INVENTION

The present invention provides a device for adjusting the quantity of molten metal used in pressure casting, the device comprising:

- a supply container for molten metal,
- a pump for pumping molten metal upwardly from the supply container,
- a pressure chamber mounted above the supply container for injecting molten metal into a mold,
- a rising pipe connecting the pump to the pressure chamber,
- a level-determining tank mounted above the supply container at the level of the pressure chamber and having a level-determining overflow,
- a branch pipe and opening to the bottom of the level-determining tank rising from a fork in the rising pipe for continuous feeding of the metal to level-determining tank in parallel with the pressure chamber whereby, in operation, the level of molten metal in the pressure chamber, and hence the quantity supplied to the mold, is determined by the level of the overflow in the tank;
- and a return pipe for returning the overflowing metal in the tank to the supply container.

Preferably the device further comprises inert gas supplied in parallel to the tank and the chamber to maintain the upper surfaces of molten metal in the tank and the chamber in contact with inert gas.

Two embodiments of the invention are described below, by way of example, with reference to the accompanying drawings.

DESCRIPTION OF THE PREFERRED EMBODIMENTS

Figure 1:
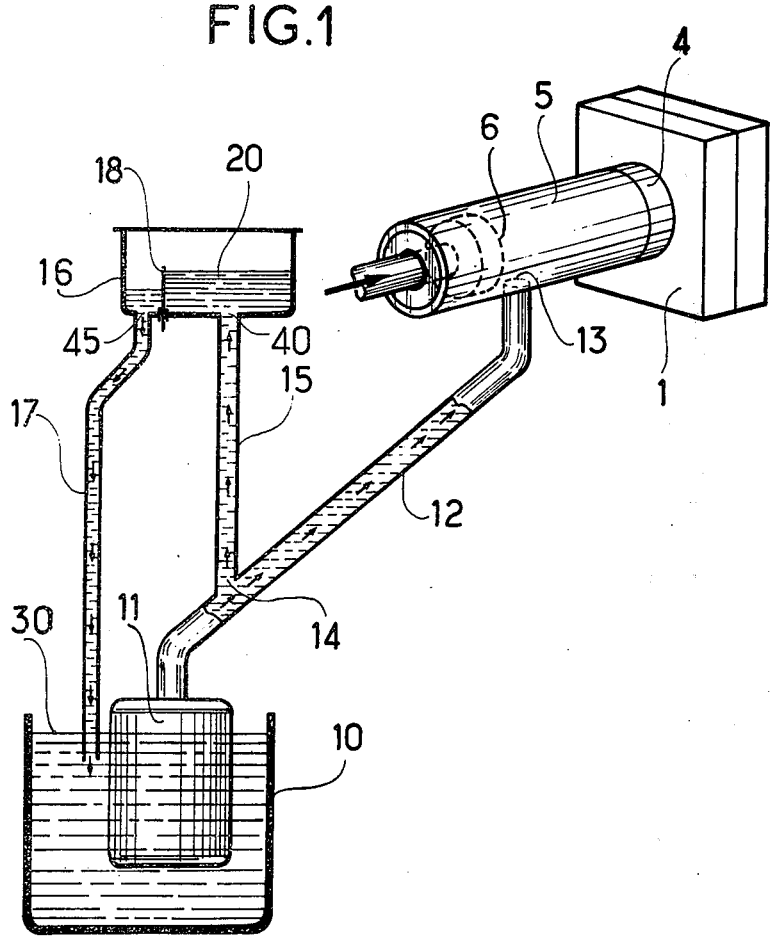
FIG. 1 is a side view in partial cross-section of a first embodiment.

In FIG. 1 a mold or die 1 has an inlet 4 provided with known means for rapid freezing of metal to plug the inlet after metal has been injected into the mold 1.

A pressure chamber comprises a cylinder 5 with a piston 6 movable therein to inject liquid metal in the cylinder 5 through the inlet 4 into the mold 1.

A crucible or holding furnace 10 has an electromagnetic pump 11 immersed in molten metal 30. The outlet of the pump 11 is connected to inlet 13 of the injection cylinder 5 to supply cylinder 5 with molten metal via a first rising pipe 12. The pipe 12 has a fork 14 from which a second rising pipe 15 projects, pipe 15 being connected at its upper end to the bottom of a level determining tank 16. A descending pipe 17 leading from the bottom of tank 16 to furnace 10 ensures the return of the overflow to holding furnace 10. A slidably mounted, vertical overflow control device 18 within tank 16 may be adjusted from above or below to enable the level of molten metal 20 in the tank 16 to be accurately fixed. The laws of hydrostatic equilibrium ensure that the level of molten metal in the injection cylinder 5 is thereby fixed and stable also.

When the piston 6 is actuated, the inlet 13 is closed off and a defined quantity of metal is injected into the mold 1.

Figure 2:
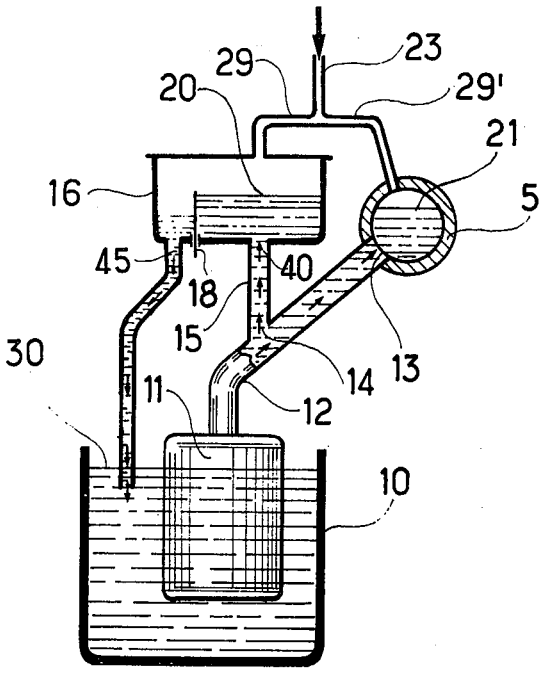
FIG. 2 is a side view in partial cross-section of a second embodiment using an inert gas for protection.

FIG. 2 is a diagrammatic view of a device which is analogous to that of FIG. 1 but in which the metal injection is done under cover of an inert gas. The injection cylinder 5 is horizontal and is shown in cross-section. The holding furnace 10, the pump 11 (which may be an induction or a conduction electromagnetic pump), the rising pipe 12, the fork 14 and the inlet 13 from the pipe 12 into the injection cylinder 5 are the same as previously described.

Inert gas protection is provided by connecting the upper most portions of the level determining tank 16 and the injection cylinder 5 to a source of inert gas as shown by the arrow by way of gas inlet pipe 23. The gas is supplied in parallel via pipes 29 and 29' leading from pipe 23 whereby the hydrostatic equilibrium of the molten metal levels in the tank 16 and the cylinder 5 is independent of possible variations in gas pressure.

Figure 3:
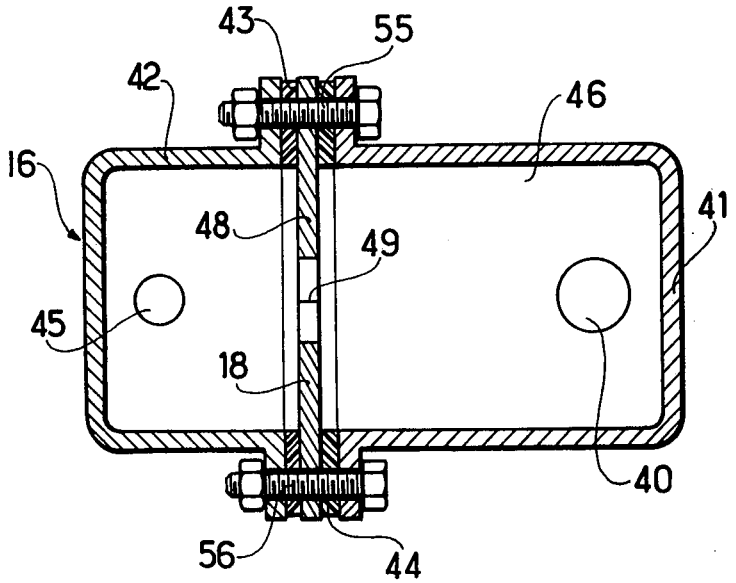
FIG. 3 is a plan view of a level determining tank.

FIG. 3 is a plan view of the level determining tank 16. The tank has laterally spaced, end wall members 41 and 42 which face one another on either side of the overflow control device 18. Seals 43 and 44 allow the level of molten metal in the tank 16 to be adjusted by sliding the control device 18 up or down. The inlet from the rising pipe 15 is disposed in the bottom of the tank 16 at 40 and the outlet to the return pipe 17 is disposed in the bottom of the tank 16 at 45.

Figure 4:
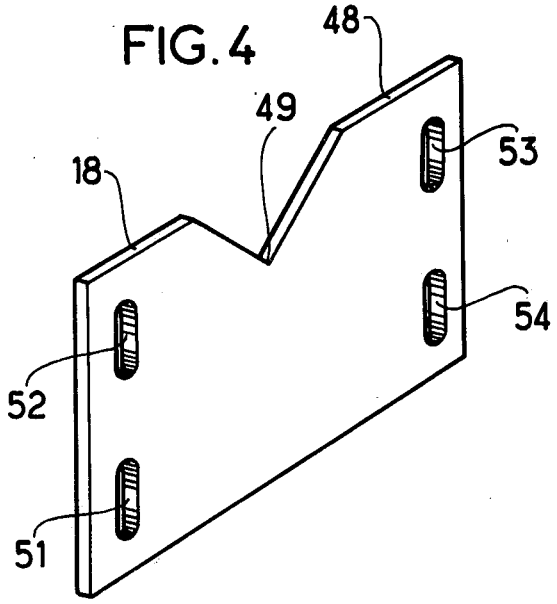
FIG. 4 is a perspective view of an adjustable overflow device.

FIG. 4 shows the overflow control element 18. This is constituted by a ceramic plate having a V-shaped notch in its upper edge. Elongated holes 51, 52, 53 and 54 allow the plate to slide relative to bolts such as 55 and 56 which pass therethrough (see FIG. 3).

The devices described above have advantages in addition to supplying accurately defined quantities of metal to the mold 1: The molten metal need not come into contact with a chemically active gas such as air. Items which are cast with a metal that has not been mixed with air, may be subjected to certain subsequent heat treatments which would otherwise be hindered by the fact of the mixing with air.

To improve the efficiency of the holding furnace 10 it is advantageous to group several pumps 11 in the same holding furnace, crucible, decanting vessel or other supply container. To save space and simplify operation, it is advantageous to use electromagnetic pumps. Further one signal pump can supply molten metal to several molds requiring different quantities of metal, each mold being associated with its own level determining tank having an overflow control device set independently. Naturally the levels cannot be allowed to diverge too far since hydrostatic equilibrium would tend to cause the metal to overflow the lowest overflow control device, but for small level differences and for sufficient supply rate from the pump small hydrostatic imbalances are compensated by dynamic effects.

Naturally further modifications of the embodiments described in detail or outlined above can be made without going beyond the scope of the present invention.

What is claimed is:

1. A device for adjusting the quantity of molten metal used in pressure casting, the device comprising:

a supply container for molten metal, a pump operatively positioned with respect to said molten metal supply container for pumping molten metal upwardly from said supply container, a pressure chamber positioned above said supply container for injecting molten metal into a mold, a rising pipe connecting said pump to said pressure chamber to feed molten metal to said pressure chamber, a level-determining tank positioned above said supply container at the level of said pressure chamber and having a level-determining overflow, a branch pipe rising from a fork in said rising pipe and connected to the bottom of said level-determining tank for continuous feeding of molten metal to said level-determining tank in parallel with said pressure chamber whereby, in operation, the level of molten metal in said pressure chamber, and hence the quantity supplied to the mold, is determined by the level of said overflow in said tank; and a return pipe projecting downward from the bottom of said level-determining tank to the side of said overflow opposite said branch pipe for returning the overflowing metal in said tank to said supply container.

2. The device according to claim 1 further comprising means for supplying inert gas in parallel to said tank and said chamber to keep the upper surfaces of molten metal in said tank and said chamber in contact with inert gas.

3. The device according to claim 1, wherein said level determining tank overflow comprises an overflow element movable in a vertical direction to set the level of said overflow.

4. The device according to claim 3, wherein said overflow element is in the form of a vertical ceramic plate with a V-shaped notch in its upper edge.

* * * * *